US008151493B2

(12) United States Patent
Dilworth et al.

(10) Patent No.: US 8,151,493 B2
(45) Date of Patent: Apr. 10, 2012

(54) PLOW SYSTEM FOR NON-HIGHWAY VEHICLES

(75) Inventors: Michael Dilworth, Muskego, WI (US); Brad Fromm, Franklin, WI (US)

(73) Assignee: Mibar Products, Ltd., Oak Creek, WI (US)

( * ) Notice: Subject to any disclaimer, the term of this patent is extended or adjusted under 35 U.S.C. 154(b) by 651 days.

(21) Appl. No.: 11/513,879

(22) Filed: Aug. 31, 2006

(65) Prior Publication Data

US 2008/0052968 A1 Mar. 6, 2008

(51) Int. Cl.
*E01H 5/04* (2006.01)

(52) U.S. Cl. ..... 37/231

(58) Field of Classification Search ..... 37/219, 37/231, 236, 266; 172/811, 828
See application file for complete search history.

(56) References Cited

U.S. PATENT DOCUMENTS

| | | | | | |
|---|---|---|---|---|---|
| 2,073,391 | A | * | 3/1937 | Greene | 172/828 |
| 2,694,267 | A | * | 11/1954 | Donnelly et al. | 37/232 |
| 2,991,566 | A | | 7/1961 | Sumner et al. | |
| 4,244,122 | A | * | 1/1981 | Hetrick | 37/234 |
| 5,044,098 | A | * | 9/1991 | Berghefer | 37/232 |
| 5,088,215 | A | * | 2/1992 | Ciula | 37/197 |
| 5,329,708 | A | * | 7/1994 | Segorski et al. | 37/231 |
| 5,435,082 | A | * | 7/1995 | Frenette et al. | 37/235 |
| 5,615,745 | A | | 4/1997 | Cross | |
| 5,832,637 | A | | 11/1998 | Aguado et al. | |
| 5,950,336 | A | | 9/1999 | Liebl | |
| 5,967,241 | A | | 10/1999 | Cross et al. | |
| 5,987,785 | A | | 11/1999 | Aguado et al. | |
| 6,088,937 | A | * | 7/2000 | DiClementi et al. | 37/232 |
| 6,178,668 | B1 | | 1/2001 | Gustafson et al. | |
| 6,334,269 | B1 | | 1/2002 | Dilks | |
| 6,581,306 | B1 | * | 6/2003 | DiClementi et al. | 37/231 |
| 6,711,837 | B2 | | 3/2004 | Bloxdorf et al. | |
| 6,732,811 | B1 | | 5/2004 | Elliott | |
| 6,817,118 | B2 | | 11/2004 | Schmeichel | |
| 6,843,002 | B1 | | 1/2005 | Moffitt | |
| 6,927,513 | B2 | | 8/2005 | Schreier | |
| 6,931,770 | B2 | | 8/2005 | Belzile | |
| 6,957,505 | B1 | | 10/2005 | Moffitt | |
| 6,964,121 | B2 | | 11/2005 | Harris | |
| 7,093,381 | B2 | | 8/2006 | Belzile | |
| 7,131,221 | B2 | | 11/2006 | Schmeichel | |
| 7,219,453 | B2 | | 5/2007 | Baker | |
| 2004/0144002 | A1 | * | 7/2004 | Baker | 37/266 |
| 2004/0205985 | A1 | | 10/2004 | Schmeichel | |

(Continued)

OTHER PUBLICATIONS

J. R. Graham Power Sports Warehouse 2005 Off-Road Dirt Bike & ATV Parts and Accessories Catalog, pp. 79-86.

*Primary Examiner* — Thomas Will
*Assistant Examiner* — Mai Nguyen
(74) *Attorney, Agent, or Firm* — Boyle Fredrickson, S.C.

(57) ABSTRACT

Non-highway vehicle plowing systems are described. The plowing system includes a mount assembly having a lower mount bracket, a plow mount bracket, an upper mount bracket, and an actuator bracket. The lower mount bracket is attached to the non-highway vehicle and the plow mount bracket is pivotably connected to the lower mounting bracket. The upper mount bracket is also secured to the non-highway vehicle and is constructed to engage the actuator bracket at a plurality of positions thereby allowing the plow mount assembly to be operable with a plurality of non-highway vehicles. The systems provide advantages in that the systems are not vehicle specific and are adaptable to different vehicle structures.

10 Claims, 4 Drawing Sheets

U.S. PATENT DOCUMENTS

| | | | |
|---|---|---|---|
| 2005/0066554 | A1 | 3/2005 | Schmeichel |
| 2006/0005433 | A1 | 1/2006 | Curtis et al. |
| 2007/0056192 | A1 | 3/2007 | Schmeichel |
| 2007/0056193 | A1 | 3/2007 | Schmeichel |
| 2007/0056194 | A1 | 3/2007 | Schmeichel |
| 2007/0056195 | A1 | 3/2007 | Schmeichel |
| 2007/0056196 | A1 | 3/2007 | Schmeichel |
| 2007/0062071 | A1 | 3/2007 | Schmeichel |
| 2007/0062072 | A1 | 3/2007 | Schmeichel |
| 2007/0062073 | A1 | 3/2007 | Schmeichel |
| 2007/0062074 | A1 | 3/2007 | Schmeichel |
| 2007/0084090 | A1 | 4/2007 | Schmeichel |
| 2007/0101620 | A1 | 5/2007 | Roy |
| 2007/0151127 | A1 | 7/2007 | Schmeichel |
| 2008/0053673 | A1 | 3/2008 | Dilworth et al. |

* cited by examiner

PLOW SYSTEM FOR NON-HIGHWAY VEHICLES

BACKGROUND OF THE INVENTION

1. Field of the Invention

The present invention relates generally to the field of plowing systems and, more particularly, to a plow system for non-highway vehicles. Specifically, a preferred embodiment of the present invention relates to an all terrain vehicle or an "ATV" plowing system.

2. Discussion of the Related Art

ATV's and other non-highway type vehicles are frequently constructed for versatility, utility, and recreation. That is, where some users frequently use the non-highway type vehicles for recreational non-highway transportation, other users utilize such equipment for more utilitarian purposes. Hunters, ranchers, farmers, and tradesman frequently have one or more such vehicles to facilitate transportation across non-paved and relatively rugged landscapes. Such equipment is commonly equipped with plowing attachments to remove debris, e.g., snow from areas where other traditional highway-type plow-equipped vehicles cannot otherwise travel due to terrain or weight restrictions.

Known plow assemblies come in a variety of shapes, sizes, and configurations. Such plow assemblies commonly include a plow which is pivotably attached to an ATV. Here, a hand-actuated lever may extend from the plow such that, during operation, an operator must manually raise and/or lower the plow via the handle. This configuration requires the operator to remove a hand from the steering and control mechanism of the all terrain vehicle to manipulate the handle attached to the plow. Accordingly, it is often problematic for the operator to concurrently steer and raise and/or lower the plow assembly. Furthermore, such configurations require the operator have a sufficient amount of strength to raise the plow assembly from its normal lowered operating position. Such a configuration prevents certain operators from performing the plowing-type operation with the ATV equipped plow.

Still other configurations are designed so the plow assembly is raised and/or lowered via actuation of a winch attached to the all terrain vehicle. Although such assemblies overcome the aforementioned drawbacks of the handle-actuated plow assembly, they are not without their own respective drawbacks. Such systems require the addition of a winch to the ATV. Accordingly, such systems increase the cost associated with the plow system. Furthermore, although the winch provides upward pressure to raise the plow from an operating position, the weight of the plow is the only down pressure generated by such assemblies. Therefore, such systems are prone to "ride up" on a plowed material. That is, when traversing uneven terrain or plowing substantial amounts of snow, the plow has a tendency to raise up above a desired plow level. Even further, the winch utilized to raise and/or lower the plow assembly is commonly geared to provide slow cable translation relative to the amount of pull force generated by the winch. Accordingly, raising and/or lowering the plow assembly is time consuming and increases the time required for a given plowing operation.

Still other ATV plow assemblies provide an actuator manipulated plow assembly. Although such systems overcome the drawbacks associated with the lack of down pressure of the winch plow assembly previously described, such systems also present their own relative deficiencies. Such assemblies are frequently tailored to specific all terrain vehicles. That is, a mounting kit specific to any particular vehicle must often be purchased in order to adapt the actuator manipulated plow assembly for connection to a specific all terrain vehicle. Accordingly, such systems increase the user and manufacturer cost associated with such systems. Furthermore, where a user has more than one all terrain vehicle, an ATV plowing assembly adapted for each vehicle must be purchased. Still further, were a user to purchase a new all terrain vehicle, an already owned plow assembly may not be connectable to the new all terrain vehicle.

Regardless of whether the plow is handle, winch, or electric/hydraulic actuator actuated as previously described, these systems suffer from a further drawback. The systems have the plow attached to the all terrain vehicle via a relatively rigid, albeit pivotable, plow mount assembly. That is, although the plow is pivotably attached to the all terrain vehicle, such systems do not address impact moments and discontinuities experienced by the plow and plow mount as the plow and all terrain vehicle traverse uneven terrain. When such plows are in a lowered position, discontinuities in the plowed terrain are translated directly through the plow mount to the all terrain vehicle. Such rigid connections translate the upward and downward pressures inflicted upon the plow directly to the all terrain vehicle. If the plow traverses terrain and rides up, it has a tendency to raise the front wheels of the all terrain vehicle, thereby negatively affecting the traction of the all terrain vehicle. As the all terrain vehicle traverses terrain with the plow in a raised position, even though the suspension of the all terrain vehicle may absorb some impacts of the terrain, the plow, being rigidly connected thereto, accentuates the bounce of the plow and translates it directly to the ATV. Accordingly, such assemblies detract from a user's comfort during a plowing operation, increase the time required for a plowing operation, or fail to adequately remove the plowed material from the terrain. Such systems also may not adequately deal with stress and strain put on the actuator and mounting assembly.

Therefore, it would be desirable to provide an all terrain vehicle plowing system that absorbs impacts as the system traverses terrain, is simple to use and/or operate, and is constructed to be connected to a plurality of all terrain vehicle constructions.

SUMMARY OF THE INVENTION

The present invention is directed to a plow mount system that overcomes the aforementioned problems. The plowing system includes a mount assembly having a lower mount bracket, a plow mount bracket, an upper mount bracket, and an actuator bracket. The lower mount bracket is attached to the non-highway vehicle and the plow mount bracket is pivotably connected to the lower mounting bracket. The upper mount bracket is also secured to the non-highway vehicle and is constructed to engage the actuator bracket at a plurality of positions thereby allowing the plow mount assembly to be operable with a plurality of non-highway vehicles. The systems provide advantages in that the systems are not vehicle specific and are adaptable to different vehicle structures.

Therefore, in accordance with one aspect of the present invention, a plowing system having a frame bracket, a plow bracket and an actuator is disclosed. The frame bracket is connectable to a vehicle body and the plow bracket is connected to the frame bracket and constructed to engage a plow blade. The actuator has an actuator first end connected to the frame bracket, and an actuator second end. The plowing system includes an actuator bracket having a first end connected to the actuator second end and attachable to the vehicle body at a plurality of positions between the first end of the actuator bracket and a second end of the actuator bracket.

In accordance with another aspect of the present invention, an all terrain vehicle is disclosed. The all terrain vehicle includes a first bracket for attaching to the vehicle, a second bracket for connecting to the first bracket and a plow, and a third bracket for pivotably connecting to the first bracket and for attaching an actuator to the vehicle. The all terrain vehicle includes an arrestor for dampening movement between the vehicle and the plow.

According to a further aspect of the present invention, a plow mount system is disclosed. The plow mount system includes a lower mount bracket assembly having a first member for engaging a frame of an all terrain vehicle and a second member for rotationally attaching to the first member and attaching a plow blade. Another aspect is a powered actuator having a first end for attaching the lower mount bracket assembly and a ram for moving a second end relative to the first end. The plow mount system includes an upper mount bracket assembly for attaching to the all terrain vehicle and an actuator bracket for attaching between the second end of the powered actuator and the upper mount bracket assembly for providing a plurality of offset distances between the all terrain vehicle and the second end of the powered actuator.

These, and other aspects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
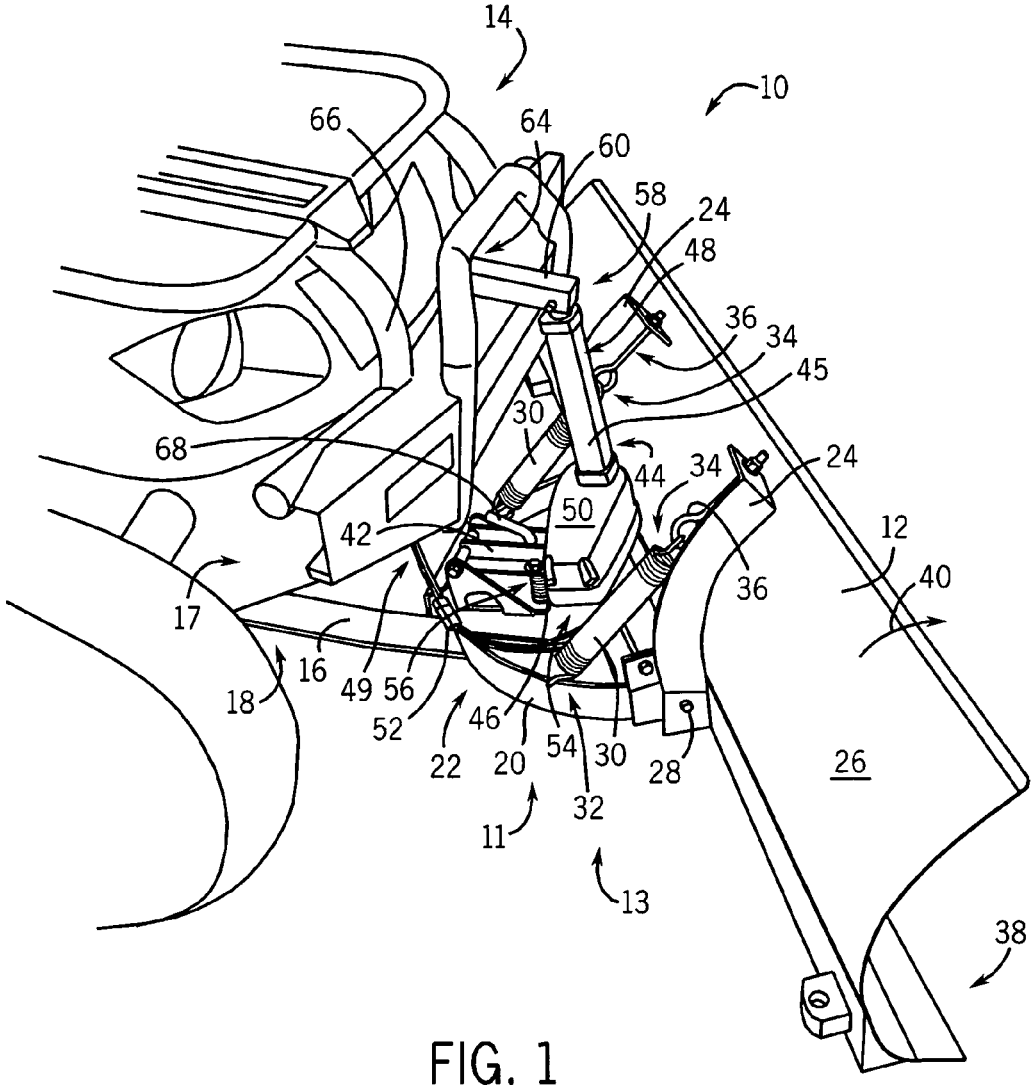
FIG. 1 is a perspective view of a plowing system according to one embodiment of the present invention.

In describing the preferred embodiments of the invention which are illustrated in the drawings, specific terminology is resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DESCRIPTION OF PREFERRED EMBODIMENT

FIG. 1 shows a plowing system and plow mount system 13 according to one embodiment of the present invention. Preferably, plowing system 10 includes a plow blade or plow 12 pivotably connected to an all terrain vehicle (ATV) 14. As used herein, ATV means an engine-driven device which has a net weight of approximately less than 1,000 pounds and which is designed to travel on three or more low-pressure tires on primarily non-highway terrain. Understandably, such non-highway vehicles include: three-wheelers, four-wheelers and amphibious vehicles, such as six-wheel and eight-wheel non-highway type vehicles.

Plowing system 10 preferably includes a plow mount system, for example, a lower mount bracket assembly or lower mount assembly 11 that includes a first member, first bracket, or frame bracket 16. A first end 18 of frame bracket 16 is attached to all terrain vehicle 14. Preferably frame bracket 16 is secured to a body or frame 17 of all terrain vehicle 14 or other structure, such as brush guards and the like secured directly thereto. Lower mount assembly 11 includes a second member, second bracket, or plow bracket 20 that is rotationally connected to frame bracket 16 proximate a second end 22 thereof.

Plow 12 includes a pair of ribs 24, which extend from a rear surface 26 of plow 12. A pin 28 passes through each of ribs 24 and pivotably attaches plow 12 to plow bracket 20. Each of a pair of springs 30 has a first end 32, which is connected to plow bracket 20, and a second end 34, which engages an adjustable connector, eye-bolt, or bolt 36. Each bolt 36 is adjustably connected to one of ribs 24 such that the tension of springs 30 can be adjusted. Springs 30 maintain plow 12 in a generally upright position unless an immovable obstruction is encountered by a blade edge 38 of plow 12 during a plowing operation. When blade edge 38 impacts an immovable obstruction, springs 30 deflect, thereby allowing plow 12 to roll, in a direction indicated by arrow 40, to minimize operator sensing of the impact and allowing plow 12 to snugly deflect about the immovable obstruction.

Lower mount assembly 11 of plow system 10 includes an intermediate bracket, or a third bracket 42 pivotably connected to frame bracket 16. An actuator assembly 44 is connected to third bracket 42. An absorber, arrestor, or shock arrestor 46 is connected to third bracket 42 between actuator assembly 44 and the pivotable connection of third bracket 42 to frame bracket 16. Shock arrestor 46 dampens movement between the vehicle and plow 12. Actuator assembly 44 presently includes an actuator 45, an extendable ram or ram 48 and a driving means, such as a pump, motor, or actuator motor 50. Actuator motor 50 is operatively connected to a power system 49 of ATV 14 via connector 52. Connector 52 extends to the controls of ATV 14, thereby allowing the operator of the ATV to control the operation of actuator motor 50 and thereby the positioning of plow 12.

An actuator first end 54 of actuator 45 is pivotably attached to lower mount assembly 11 proximate one or a first end 56 of third bracket 42. Another or second end 58 of actuator 45 is pivotably connected to an actuator bracket 60. As shown in FIG. 1, a first end 62 of actuator bracket 60 is pivotably connected to second end 58 of actuator 45, and a second end 64 of actuator bracket 60 is rigidly connected to ATV 14. Preferably, the second end 64 is also securely connected to a frame member 66 of ATV 14. During operation of actuator motor 50, ram 48 extends and retracts in response to the operator inputs communicated to actuator assembly through connector 52. When ram 48 is located in an extended position, plowing system 10 applies a down pressure at blade edge 38 of plow 12. When an operator desires to raise the plow, ram 48 of actuator assembly 44 is retracted, thereby raising leading edge 38 of plow 12 from a ground surface.

As shown in FIG. 1, plow 12 is also pivotably connected to ATV 14 to allow plow 12 to be pitched relative to a direction of travel of the ATV. A pitch pin 68 is disposed between third brackets 42, passes through plow bracket 20 and engages frame bracket 16, thereby securing the angled position of plow 12 relative to ATV 14. Pitch pin 68 is manually operable to allow an operator, upon releasing pitch pin 68, to manually pivot plow 12 relative to frame bracket 16, thereby allowing plow 12 to be conveniently oriented at a plurality of application specific pitches without altering the construction of the components of mount assembly 11. Such a construction allows snow to be plowed to alternating sides of the ATV rather than simply in the direction of travel of the ATV.

Figure 2:
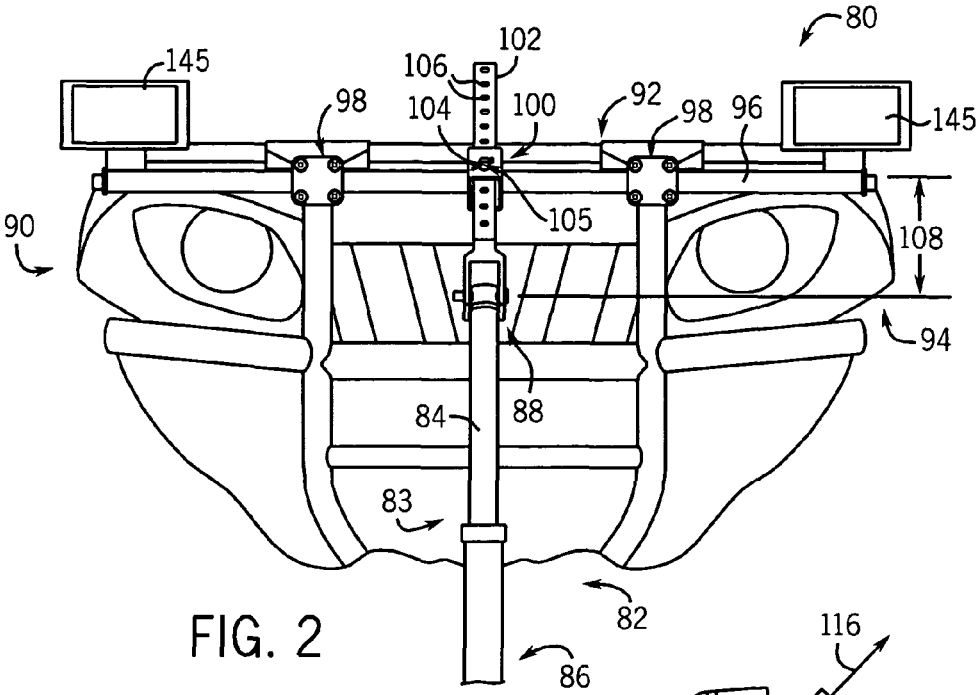
FIG. 2 is an elevational end view of another embodiment of a plowing system in accordance with the present invention.

FIG. 2 shows another plowing system 80 according to the present invention. Plowing system 80 includes an actuator assembly 82 having a powered actuator or actuator 83 and an extendable ram 84 connected thereto. A first end 86 of actuator assembly 82 is connected to a lower mount bracket assembly or lower mount assembly 112 substantially similar to lower mount assembly 11 shown in FIG. 1. A second end 88 of actuator assembly 82 is pivotably connected to a mount bracket or variable position upper mount assembly 90. Upper mount assembly 90 includes an actuator bracket mount or upper mount bracket assembly 92 constructed to engage an ATV 94 independent of the particular construction of ATV 94. Upper mount bracket assembly 92 includes a crossbar 96 and a pair of frame connectors 98. Crossbar 96 includes an actuator bracket pocket 100 constructed to slidably engage an offset bracket or actuator bracket 102. A pin 104 is constructed to pass through an opening or passage 105 formed through actuator bracket pocket 100 of crossbar 96 and removably engage a plurality of openings 106 formed in actuator bracket 102. Such a construction defines a variable offset 108 between second end 88 of actuator assembly 82 and ATV 94.

Figure 3:
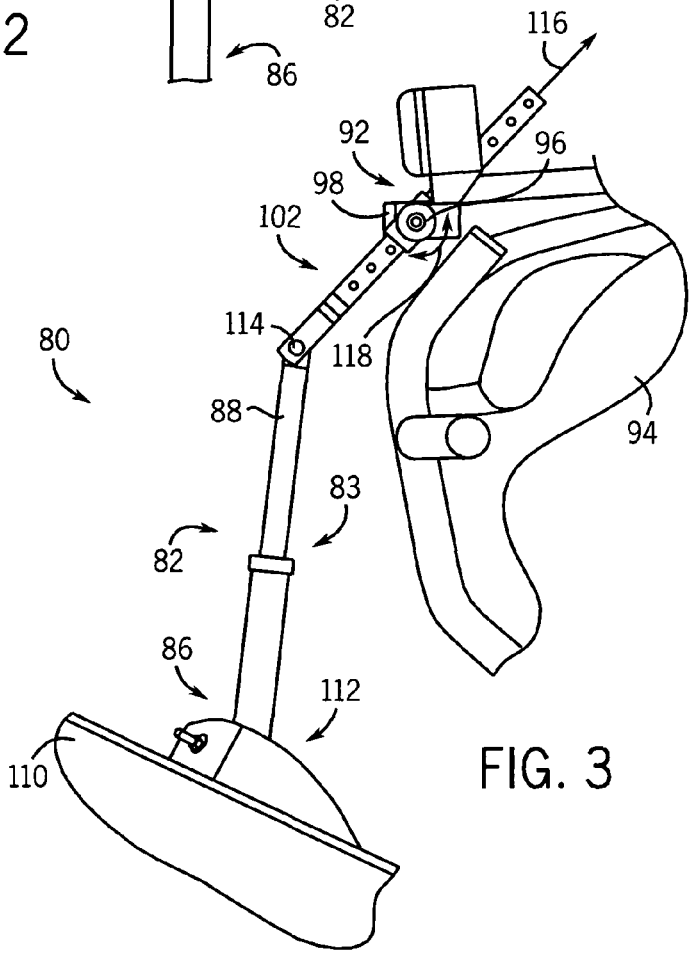
FIG. 3 is an elevational side view of the plowing system shown in FIG. 2.

FIG. 3 shows an elevational view of the plowing system 80 shown in FIG. 2. Plowing system 80 includes a plow 110 connected to first end 86 of actuator assembly 82 and pivotably connected to ATV 94 via a lower mount assembly 112, which is substantially similar to lower mount assembly 11 shown in FIG. 1. Second end 88 of actuator assembly 82 is pivotably connected to actuator bracket 102 via a removable connector, such as a pin 114. Actuator bracket 102 is linearly translatable about an axis, indicated by arrow 116, relative to upper mount bracket assembly 92 thereby allowing connection of actuator bracket 102 to ATV 94 at a plurality of positions. Crossbar 96 is rotatable, indicated by arrow 118, relative to frame connectors 98, thereby rotating axis 116 of actuator bracket 102 about the axis of crossbar 96. Such a construction allows plow system 10 to connect to a variety of all terrain vehicles independent of the specific frame construction of the all terrain vehicle. Additionally, such construction allows plow system 10 to be configured for operation when the other systems of the ATV are reconfigured. For example, suspension components such as shocks, springs, or tires can be varied to achieve a desired ride or suspension configuration of the ATV and plow system 10 would still be operable with the ATV. Accordingly plowing system 80 is highly versatile and functional with ATV's constructed by different manufacturers and/or having different front end/frame assemblies, sub-assemblies as between different model years from a common manufacturer.

Figure 4:
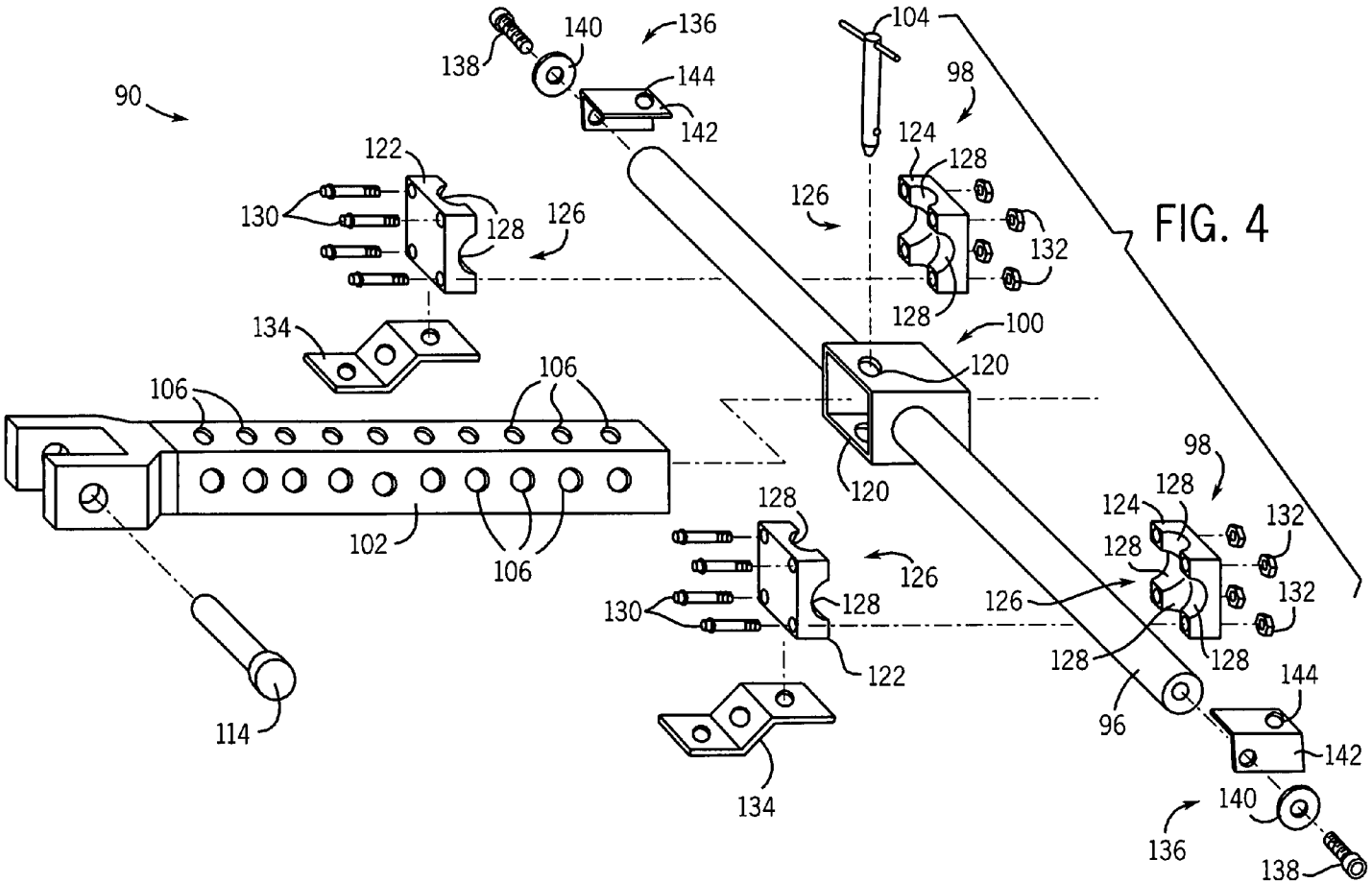
FIG. 4 is a perspective exploded view of a portion of the plowing system shown in FIG. 3.

FIG. 4 shows upper mount assembly 90 and actuator bracket 102 removed from an ATV. Crossbar 96 includes actuator bracket pocket 100 generally centrally disposed thereon. Actuator bracket pocket 100 includes a pair of openings 120 formed therein constructed to engage pin 104. Actuator bracket 102 is slidably positionable within actuator bracket pocket 100 of crossbar 96 such that a respective pair of openings 106 align with openings 120 so that pin 104 can pass therethrough, thereby securing actuator bracket 102 to crossbar 96. Upper mount assembly 90 includes a plurality of frame connectors 98. Each frame connector 98 includes a front connector 122 and a rear connector 124. An inside surface 126 of each front connector 122 and rear connector 124 includes a plurality of arcuate surfaces 128. Arcuate surfaces 128 are constructed to snugly engage crossbar 96 when front connector 122 and rear connector 124 are secured together via a plurality of fasteners 130 and associated nuts 132. A connector bracket 134 is constructed to be secured to each of frame connectors 98 and engaged with a frame of an ATV. Frame connectors 98 and connector brackets 134 cooperatively allow upper mount assembly 90 to be secured to a plurality of ATV frame constructions.

Upper mount assembly 90 includes an optional light mount assembly 136 disposed at generally opposite ends of crossbar 96. Light mount assemblies 136 are secured to crossbar 96 via a fastener 138 and an associated washer 140. Each light mount assembly includes a light bracket 142 having an opening 144 formed therein and constructed to engage a light element 145, as shown in FIG. 2. As shown in FIG. 2, optional light mount assembly 136 mounts to light element 145 above the raised operating position of the plow attached thereto, thereby allowing night time utilization of plowing systems 10, 80. Preferably, light brackets 142 are secured to crossbar 96 to allow independent positioning of the individual lights connected to the cross-bar.

Figure 5:
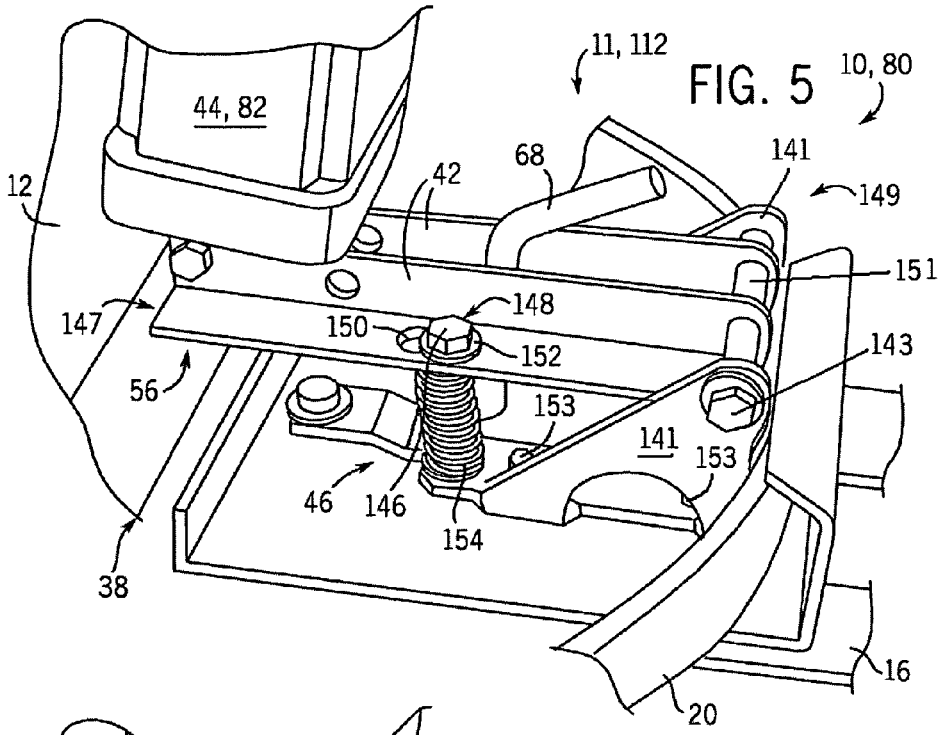
FIG. 5 is a perspective view of a shock arrestor of the plowing systems shown in FIG. 1 or FIG. 2.
Figure 6:
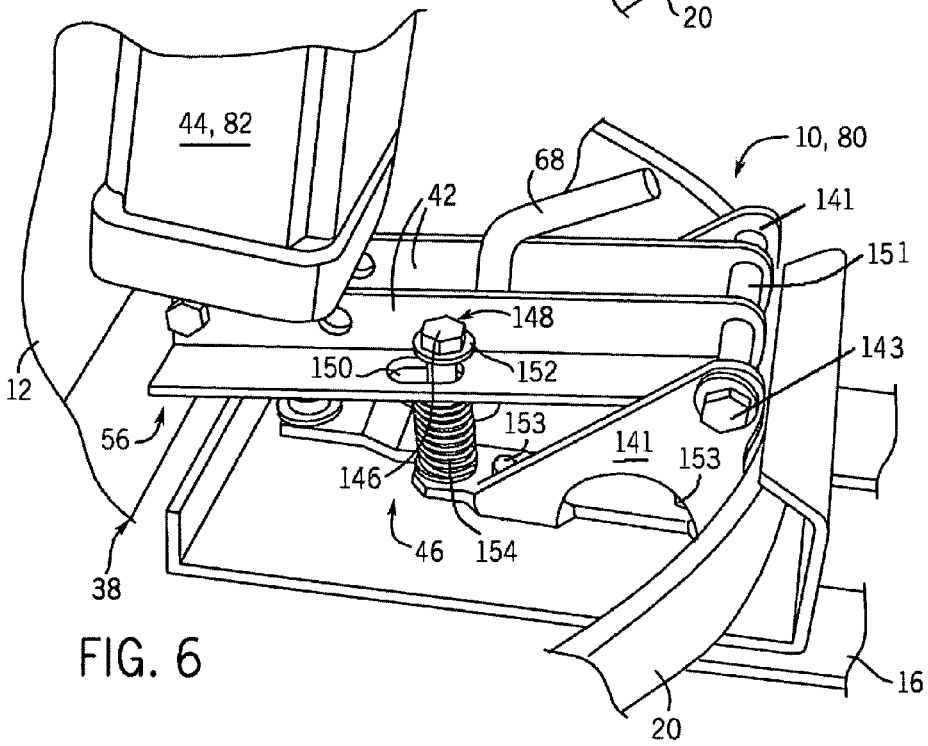
FIG. 6 is a perspective view similar to FIG. 5 with the shock arrestor deflected to an alternate position.

FIGS. 5 and 6 show the arrestor of plow systems 10, 80. Third brackets 42 are pivotably attached to a pair of extension brackets 141 by a fastener 143 that passes through an optional sleeve 151 and pivotably secures third brackets 42 to extension brackets 141. A plurality of fasteners 153 pass through corresponding openings in the extension bracket 141 and secure the extension brackets 141 to frame brackets 16. Extension brackets 141 allow third brackets 42 to move relative to frame bracket 16.

As shown in FIG. 5, arrestor 46 includes a support pin or pin 146, which is connected between third brackets 42 and plow bracket 20. Each third bracket 42 has one end 147 pivotable connected to first end 56 of actuator assembly 44, 82 and another end 149 pivotable connected to lower mount assembly 11, 112. Each pin 146 includes a head 148 positioned proximate each third bracket 42. Each pin 146 passes through an opening 150 formed in each of third brackets 42. A washer 152 is disposed between third bracket 42 and head 148 of arrestor pin 146 and protects head 148 from interfering with movement of third bracket 42. As shown in FIG. 5, when cutting edge 38 is lowered to a desired operating position or plow 12 is raised above a terrain, third brackets 42 are maintained in close proximity to head 148 of arrestor 46 by the weight of plow 12 and by a spring 154. As shown in FIG. 6, when plow 12 encounters an obstruction during a plowing operation, plow bracket 20 deflects upwardly, thereby compressing spring 154 between plow bracket 20 and third brackets 42. As shown in FIGS. 5 and 6, pin 146 defines a maximum distance between third brackets 42 and frame bracket 16, and spring 154 defines a minimum distance therebetween.

Accordingly, arrestor 46 allows plow 12 and plow bracket 20 to move independent of actuator 45. Such a construction reduces the impact of an obstruction that is translated through plowing systems 10, 80 to the frame of the ATV connected thereto. Similarly, when in a raised position, arrestor 46 dampens vibrational "bounce" of plow 12 as all terrain vehicle moves across uneven terrain. Such a construction minimizes the effects of plow bounce during non-operational transportation of the plow, as well as operational impacts subjected to the plow thereby reducing operator fatigue during a plowing process. Accordingly, arrestor 46 reduces the potential of damaging plow system 10, lower mount assemblies 11, 112, actuator assembly 44, 82, and upper mount assembly 90, or ATV 14 from plow impacts.

Therefore, one embodiment of the present invention includes a plowing system having a frame bracket, a plow bracket and an actuator. The frame bracket is connectable to a vehicle body and the plow bracket is connected to the frame bracket and constructed to engage a plow blade. The actuator has an actuator first end connected to the frame bracket, and an actuator second end. The plowing system includes an actuator bracket having a first end connected to the actuator second end and attachable to the vehicle body at a plurality of positions between the first end of the actuator bracket and a second end of the actuator bracket.

Another embodiment of the invention includes an all terrain vehicle having a first bracket for attaching to the vehicle, a second bracket for connecting to the first bracket and a plow, and a third bracket for pivotably connecting to the first bracket and for attaching an actuator to the vehicle. The all terrain vehicle includes an arrestor for dampening movement between the vehicle and the plow.

According to a further embodiment of the present invention, a plow mount system includes a lower mount bracket having a first member for engaging a frame of an all terrain vehicle and a second member for rotationally attaching to the first member and attaching a plow blade. Another aspect is a powered actuator having a first end for attaching the lower mount bracket and a ram for moving a second end relative to the first end. The plow mount system includes an upper mount bracket for attaching to the all terrain vehicle and an actuator bracket for attaching between the second end of the powered actuator and the upper mount bracket for providing a plurality of offset distances between the all terrain vehicle and the second end of the powered actuator.

The present invention has been described in terms of the preferred embodiment, and it is recognized that equivalents, alternatives and modifications, aside from those expressly stated, are possible and within the scope of the appending claims.

What is claimed is:

1. A plowing system comprising:

a frame bracket connectable to a vehicle body;

a plow bracket pivotably connected to the frame bracket and constructed to engage a plow blade such that the plow blade is laterally pivotable relative to the frame bracket;

an actuator having an actuator first end connected to the frame bracket at a location forward of a rearmost edge of the plow bracket and so that operation of the actuator vertically rotates the plow blade relative to the vehicle body and an actuator second end so that only paths along the frame and plow brackets and the actuator connect the plow to the vehicle body;

an offset bracket pivotably connected in series between the actuator first end and the frame bracket;

a shock arrestor connected between the offset bracket and the plow bracket to allow the plow bracket to move in a vertical direction independent of the frame bracket and independent of a length of the actuator; and an actuator bracket having a first end connected to the actuator second end and attachable to the vehicle body between the first end of the actuator bracket and a second end of the actuator bracket so that the actuator provides down-pressure to the plow blade that is greater than a weight of the plow blade and plow bracket throughout an operating length of the actuator.

2. The plowing system of claim 1 wherein the shock arrestor further comprises a support pin that defines a maximum distance between the offset bracket and the frame bracket and a spring that defines a minimum distance between the offset bracket and the frame bracket.

3. The plowing system of claim 1 further comprising a motor connected to the actuator for controlling extension and retraction of a ram of the actuator and whose operation is solely responsible for a length of the actuator.

4. The plowing system of claim 1 further comprising a pair of springs attached to the plow bracket and constructed to engage a plow attached thereto, the springs being disposed on generally opposite sides of the plow bracket.

5. The plowing system of claim 1 wherein the vehicle body is an all terrain vehicle.

6. An all terrain vehicle comprising:

a first bracket for attaching to the vehicle;

a second bracket for connecting to the first bracket and a plow;

a third bracket pivotably connected to the first bracket in a cantilevered orientation so that the third bracket extends in a forward direction over the second bracket and for attaching an actuator that is operable to rotate the second bracket and the plow relative to a vertical plane and to the vehicle; and an arrestor that is connected in series with the actuator between the first bracket and the third bracket and positioned between the pivotable connection of the third bracket with the first bracket and a connection of the actuator with the third bracket, the arrestor and the actuator oriented to define positioning of the plow relative to the vehicle and so that only the arrestor allows upward directed movement of the plow relative to the actuator due to vertical forces imparted to the plow.

7. The all terrain vehicle of claim 6 wherein the arrestor further comprises a pin for attaching the third bracket and the second bracket for allowing axial displacement therebetween and a spring for resisting the axial displacement.

8. The all terrain vehicle of claim 6 further comprising an actuator bracket for connecting an end of the actuator generally opposite the third bracket to the all terrain vehicle.

9. The all terrain vehicle of claim 8 further comprising an actuator bracket mount connected to the all terrain vehicle for allowing the actuator bracket to engage therewith.

10. The vehicle of claim 6 further comprising a motor attached to the actuator and connected to a power system of the all terrain vehicle for non-fluidly controlling a position of a ram of the actuator.

* * * * *